US011920447B2

(12) United States Patent
Morris et al.

(10) Patent No.: US 11,920,447 B2
(45) Date of Patent: Mar. 5, 2024

(54) METHOD OF OIL RECOVERY BY IMPRESSED CURRENT

(71) Applicant: YPF TECNOLOGÍA S.A., Ciudad Autonoma de Buenos Aires (AR)

(72) Inventors: Walter Morris, Neuquén Prov. de Neuquén (AR); Albert Ulises Saavedra Olaya, La Matanza Prov. de Buenos Aires (AR)

(73) Assignee: YPF TECNOLOGÍA S.A., Ciudad Autonoma de Buenos Aires (AR)

( * ) Notice: Subject to any disclaimer, the term of this patent is extended or adjusted under 35 U.S.C. 154(b) by 0 days.

(21) Appl. No.: 17/592,228

(22) Filed: Feb. 3, 2022

(65) Prior Publication Data

US 2022/0243572 A1 Aug. 4, 2022

Related U.S. Application Data

(60) Provisional application No. 63/145,172, filed on Feb. 3, 2021.

(51) Int. Cl.
*E21B 43/24* (2006.01)

(52) U.S. Cl.
CPC ..... *E21B 43/2401* (2013.01)

(58) Field of Classification Search
CPC ..... E21B 43/2401
See application file for complete search history.

(56) References Cited

U.S. PATENT DOCUMENTS 3,642,066 A * 2/1972 Gill ..... E21B 43/16 166/248
4,228,854 A 10/1980 Sacuta
4,884,634 A * 12/1989 Ellingsen ..... E21B 43/003 166/248
4,951,748 A * 8/1990 Gill ..... E21B 47/07 73/152.55

(Continued)

FOREIGN PATENT DOCUMENTS

WO WO-8703643 A * 6/1987 ..... E21B 43/003
WO WO-03038230 A2 * 5/2003 ..... E21B 43/16

(Continued)

OTHER PUBLICATIONS

Meiyi Qing, Huaqing Liang, Jinjun Zhang, and Honglei Zhan , "Impedance spectroscopy dependent water content detection in dynamic oil-water emulsions", AIP Advances 8, 105306 (2018) https://doi.org/10.1063/1.5047924, 10 pages (Year: 2018).*

*Primary Examiner* — Jennifer H Gay
(74) *Attorney, Agent, or Firm* — Muncy, Geissler, Olds & Lowe, P.C.

(57) ABSTRACT

A method of oil recovery by applying an electrical signal to a reservoir of interest, wherein said method comprises the following steps: obtaining the characteristic frequency of the water-oil interface of the reservoir; and applying the electrical signal to the reservoir, wherein said electrical signal is an alternating current signal or a combination of a direct current signal and an alternating current signal, and wherein the frequency of the alternating current signal is the characteristic frequency of the water-oil interface, thereby producing alteration of the water-oil interface and movement of the oil for extraction.

12 Claims, 10 Drawing Sheets

(56) References Cited

U.S. PATENT DOCUMENTS

| | | | | |
|---|---|---|---|---|
| 6,499,536 | B1 * | 12/2002 | Ellingsen | E21B 43/24 166/371 |
| 6,877,556 | B2 * | 4/2005 | Wittle | E21B 43/16 166/248 |
| 7,322,409 | B2 * | 1/2008 | Wittle | E21B 43/2401 166/248 |
| 9,829,421 | B2 * | 11/2017 | Palla | E21B 33/14 |
| 9,945,767 | B2 * | 4/2018 | Palla | G01N 13/00 |
| 2003/0102123 | A1 * | 6/2003 | Wittle | E21B 43/2401 166/248 |
| 2005/0161217 | A1 * | 7/2005 | Wittle | E21B 43/16 166/248 |
| 2005/0199387 | A1 * | 9/2005 | Wittle | E21B 43/2401 166/248 |
| 2010/0078165 | A1 * | 4/2010 | Seleznev | E21B 49/00 166/66 |
| 2012/0152570 | A1 * | 6/2012 | Thomas | E21B 43/16 166/400 |
| 2015/0192004 | A1 * | 7/2015 | Saeedfar | E21B 47/13 166/57 |
| 2016/0216190 | A1 * | 7/2016 | Palla | G01N 13/00 |
| 2018/0045633 | A1 * | 2/2018 | Palla | E21B 33/14 |
| 2022/0243572 | A1 * | 8/2022 | Morris | E21B 49/0875 |
| 2022/0372854 | A1 * | 11/2022 | Mlinar | E21B 43/16 |

FOREIGN PATENT DOCUMENTS

| | | | | |
|---|---|---|---|---|
| WO | WO2016/045682 | A1 | 3/2016 | |
| WO | WO-2021005383 | A1 * | 1/2021 | E21B 43/16 |

* cited by examiner

METHOD OF OIL RECOVERY BY IMPRESSED CURRENT

CROSS REFERENCE TO RELATED APPLICATIONS

This application claims priority of U.S. Provisional Application No. 63/145,172 filed on Feb. 3, 2021 under 35 U.S.C. § 119(e), the entire contents of which are hereby incorporated by reference.

FIELD OF THE INVENTION

The present invention relates to the recovery of oil from a reservoir. Particularly, the present invention relates to a method for increasing the mobility of residual oil from reservoirs under secondary or tertiary recovery by applying alternating impressed current at a certain frequency to a reservoir.

BACKGROUND OF THE INVENTION

EEOR (Electrical Enhanced Oil Recovery) systems are used to increase oil production in heavy or extra-heavy crude oil reservoirs. These systems are based on the generation of heat in the reservoir from the Joule effect caused by the passage of alternating current (AC) or direct current (DC). The heat reduces the viscosity of the crude oil and increases its mobility.

Among the main factors affecting the formation of oil-water emulsions are the droplet size of the dispersed phase, the difference in viscosity and density of the fluids and the interfacial tension. The electrostatic equilibrium generated between the polar molecules present at the oil-water interface plays a preponderant role in the formation and stability of oil-water emulsions. The polar components of the crude oil (asphaltenes, resins and sulfur compounds) and the polar nature of water favor the formation of these interfaces. In addition, the presence of small solid particles (clays, oxides, sulfates and sulfides) tend to further stabilize these interfaces.

There are prior art documents such as U.S. Pat. No. 4,228,854 A which is directed to an electrical enhanced oil recovery (EEOR) system that consists in applying a DC signal between a production well (Anode) and water injection well/s (Cathode) to increase the sweep efficiency and delay the early inrush of water from the injection well to the production well. This application is preferably used in heavy crude oil reservoirs under secondary recovery.

In addition, patent application WO 2016/045682 A1 is directed to an electrical enhanced oil recovery method in which a controlled electrical charge potential is imposed between two or more conductive elements so as to generate a capacitive charge in a rock formation at an operating charge potential.

In general, tertiary electrical recovery methods known in the art require large energy consumption and are not entirely efficient in terms of oil recovery as they leave a large amount of crude oil unextracted.

There is a need to provide a method of oil recovery with improved efficiency, requiring less energy consumption and not leaving a large amount of crude oil unextracted.

BRIEF DESCRIPTION OF THE INVENTION

Consequently, it is an object of the present invention a method of oil recovery by applying an electrical signal to a reservoir of interest, wherein said method comprises the following steps:

obtaining the characteristic frequency of the water-oil interface of the reservoir; and applying the electrical signal to the reservoir, wherein said electrical signal is an alternating current signal or a combination of a direct current signal and an alternating current signal, and wherein the frequency of the alternating current signal is the characteristic frequency of the water-oil interface, thereby producing alteration of the water-oil interface and movement of the oil for extraction.

In an embodiment of the present invention, the step of obtaining the characteristic frequency comprises collecting wellhead oil samples and water samples from the reservoir, and subjecting the oil samples and water samples to electrochemical impedance spectrometry (EIS) tests.

In an embodiment of the present invention, the oil samples are combined with the water samples to obtain different water cuts or water-oil ratios from 100% water and 0% oil to 0% water and 100% oil, and subjected to electrochemical impedance spectrometry tests.

In an embodiment of the present invention, the electrochemical impedance tests are carried out by applying signals from 1 MHz to 100 mHz.

In an embodiment of the present invention, electrochemical cells are used to carry out the electrochemical impedance tests.

In an embodiment of the present invention, the impedance spectra obtained from the electrochemical impedance spectrometry tests are fitted to an equivalent electrical circuit to characterize the oil-water system and determine the characteristic frequency of the oil-water interface.

In a preferred embodiment of the present invention, the equivalent electrical circuit is a Randles circuit.

In an embodiment of the present invention, the step of applying the electrical signal to the reservoir comprises connecting at least one injection well with at least one production well.

In an embodiment of the present invention, the step of applying the electrical signal to the reservoir comprises connecting a plurality of injection wells together, wherein said injection wells surround at least one production well.

In an embodiment of the present invention, the at least one injection well and the at least one production well are cased with steel casing.

In an embodiment of the present invention, at least one of the at least one injection well and the at least one production well is cased with GFRE (glass fiber reinforced epoxy) casing.

In an embodiment of the present invention, at least one of the at least one injection well is cased with GFRE casing and the at least one production well is cased with steel casing.

In an embodiment of the present invention, at least one of the at least one production well is cased with GFRE casing and the at least one injection well is cased with steel casing.

In an embodiment of the present invention, the at least one injection well and the at least one production well are cased with GFRE casing.

In an embodiment of the present invention, the plurality of injection wells that surround at least one production well is cased with steel casing.

In an embodiment of the present invention, at least one of the plurality of injection wells that surround at least one production well is cased with GFRE casing, preferably each of the plurality of injection wells is cased with GFRE casing.

In an embodiment of the present invention, an electrode is lowered down, through the interior of each well cased with GFRE casing, to the reservoir of interest.

In an embodiment of the present invention, the step of applying the electrical signal to the reservoir comprises applying the electrical signal directly through the steel casing for wells cased with steel casing, and through the electrodes for wells cased with GFRE casing.

DETAILED DESCRIPTION OF THE INVENTION

Figure 1A:
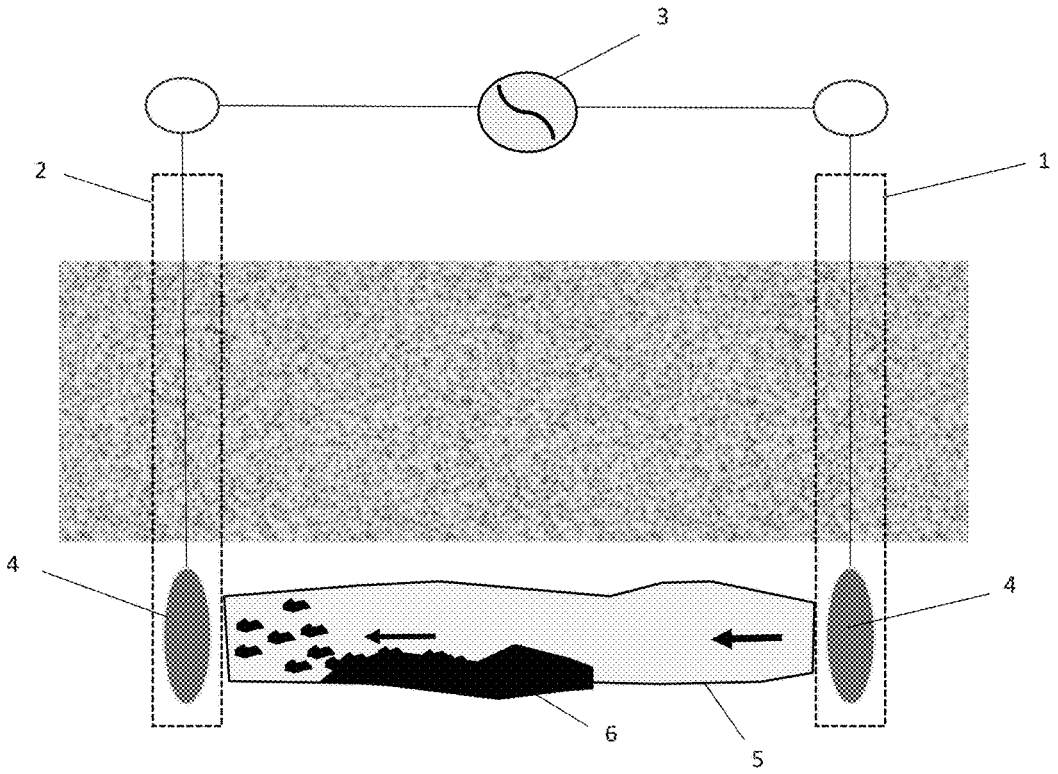
FIG. 1A shows a schematic drawing of an embodiment of the method of the present invention.

For the purposes of the present invention the terms "crude oil" and "oil" are used interchangeably so as to refer in both cases to a mixture of organic compounds consisting mainly of hydrocarbons.

The method of the present invention consists of a method of crude oil recovery by applying an electrical signal to a reservoir, also referred to as a method of electrical oil stimulation or electrical enhanced oil recovery (EEOR). In particular, the method of the present invention aims to increase the mobility of residual crude oil and to promote the coalescence of droplets retained in the pore network of the rock, employing a principle of electrical separation of emulsions, so as to increase the volume of crude oil extracted from a reservoir. This method of the present invention can be carried out under secondary or tertiary recovery.

In a first step of the method of the present invention, the characteristic frequency of the oil-water interface of a reservoir of interest is obtained. In an embodiment of the method of the present invention, the characteristic frequency is obtained by collecting wellhead crude oil samples from the reservoir of interest and subjecting them to tests so as to determine said characteristic frequency. Preferably, said tests are electrochemical impedance spectrometry (EIS) tests, where different volumes of oil with different volumes of water are combined so as to obtain water cuts with different proportions of oil, i.e., water cuts between 0% and 100%, wherein the proportions are made in volume. In this way, the oil-water interface can be characterized by EIS spectra.

The volumes of water are obtained by collecting samples of the injection water that is pumped into the reservoir of interest, and of the production water that is obtained from the production well, coming from the reservoir of interest.

Injection water should be understood as water that is injected into an injection well and that has been previously treated in a plant, and production water should be understood as water that comes out of a production well and that is mixed with crude oil and other components present in a reservoir, such as salts, solids and crude oil from the formation.

An electrochemical impedance test should be understood as a test where an electric potential signal is applied between electrodes and its current response is measured at different frequencies. In this way, the electronic equipment used for said test processes the potential, current and time measurements, resulting in a series of impedance values corresponding to each frequency studied. This relationship of impedance and frequency values is called the "impedance spectrum".

Impedance data obtained by EIS spectra are usually represented in the form of complex impedance or Nyquist plots, accompanied by Bode plots in which the magnitude and phase angle are represented as a function of frequency.

The Nyquist plot is a type of representation that relates the real impedance to the imaginary impedance of a system. Generally, the real impedance is represented on the abscissa axis and the imaginary impedance on the ordinate axis, and a curve is drawn where each point represents a given frequency value. In this way, the global impedance of the system will be characterized.

The Bode diagram is a representation method that reflects the behavior of the impedance with respect to frequency. The Bode plot is divided into two representations. The first one describes the relationship of the impedance magnitude with frequency, and the second one describes the phase angle with frequency. The frequency is usually plotted in logarithmic scale to better highlight the behavior at low frequencies.

In particular, for the present method, impedance spectra are obtained by carrying out electrochemical impedance tests, with different proportions of water and crude oil, at open circuit potential (OCP), i.e., without a direct current (DC) component, with a signal amplitude of, for example, 10 mV, 100 mV or 1000 mV at a frequency range varying from, for example, 1 MHz to 100 mHz. Such values and/or ranges are by way of example only and should not be considered as limiting, thus, other values and/or ranges could be used as needed.

To carry out such electrochemical impedance tests, an electrochemical cell such as a two-electrode, two-phase (oil and water) cell may be used to characterize the oil-water system, including the oil-water interface.

As previously mentioned, different water-oil ratios or water cuts such as 100% water, 95% water and 5% oil, 90% water and 10% oil, 75% water and 25% oil, 50% water and 50% oil, 25% water and 75% oil, and 100% oil, may be used for testing in such a cell. These ratios are by way of example only and should not be considered as limiting, thus, other oil to water ratios could be used.

Therefore, to determine the characteristic frequency of the water-oil system, tests are carried out with each of the fluids separately in order to determine the characteristic electrochemical parameters thereof, as well as tests with different water cuts.

The spectra obtained are modeled using equivalent electrical circuits in order to determine the electrical parameters of the components that simulate the system under study. In particular, the Randles electrical circuit is used to model the obtained spectra. These tests allow to determine the characteristic frequency (CF) at which the greatest alteration of the interface occurs. From these models, the CF of the water-oil interface is obtained, preferably, in the form of a range of optimal values through which it is possible to mobilize crude oil that is trapped in the reservoir. In a preferred embodiment, the average of this range of optimal values is adopted as the CF.

In a second step of the method of the present invention, once the characteristic frequency of the water-oil interface of the reservoir of interest is obtained, an electrical signal is applied to the reservoir of interest.

In an embodiment of the second step of the method of the present invention, at least one injection well is electrically connected to at least one production well.

In this embodiment, the casing of the wells may be in any of the following forms: both the at least one injection well and the at least one production well are cased with steel casing; at least one of the at least one injection well and the at least one production well is cased with GFRE (glass fiber reinforced epoxy) casing; at least one of the at least one injection well is cased with GFRE casing and the at least one production well is cased with steel casing; at least one of the at least one production well is cased with GFRE casing and the at least one injection well is cased with steel casing; and both the at least one injection well and the at least one production well are cased with GFRE casing.

If, for example, the at least one injection well is cased with GFRE casing and the at least one production well is cased with steel casing, an electrode is lowered, by means of a cable, inside each injection well, and the at least one injection well is connected to the at least one production well, cased with steel casing, through a power source. It should be noted that it could be the other way around, i.e., the at least one production well is cased with GFRE casing and thus an electrode is lowered, by means of a cable, inside each production well and the at least one production well is connected to the at least one injection well, cased with steel casing, through a power source.

In case both the at least one injection well and the at least one production well are cased with GFRE casing, an electrode is lowered by means of a cable inside each injection well with GFRE casing, and another electrode is lowered through another cable inside each production well with GFRE casing so that both the electrodes in the injection wells and the production wells are located in the reservoir of interest, thus generating a low resistance electrical circuit that focuses stimulation in the zone of interest in the well.

Regardless of whether the injection and production wells are cased with GFRE and/or steel casing, the injection and production wells are connected, either through the steel casing or through the electrodes for wells with GFRE casing, to a power source for applying the electrical signal, wherein said electrical signal is an alternating current (AC) signal or a combination of a direct current signal and an alternating current signal. Thus, different well connection configurations can be considered. By way of example, a convenient configuration is to connect the at least one injection well as the cathode and the at least one production well as the anode. In another configuration, the anode and cathode may be established in two or more injection wells such that the neighboring production well(s) are associated with the energized injection wells.

It is preferable to use GFRE casing so that the current is not dissipated along the stratigraphic column. To this end, an electrode is installed inside each GFRE well and positioned in front of the punctures of the zone of interest in the reservoir. The GFRE casing does not conduct current unlike the steel casing which does and, consequently, dissipates the energy supplied to subsurface zones that are not of interest.

Lowering the electrodes down the wells with GFRE casing into the reservoir of interest allows focusing the application of the method on the specific layer to be swept (and not the entire subsurface).

In another embodiment of the second step of the method of the present invention, a plurality of injection wells is electrically connected together, wherein said injection wells surround at least one production well, and wherein said at least one production well is not electrically connected to the plurality of injection wells.

In this embodiment, the casing of the plurality of injection wells may be in any of the following forms: the plurality of injection wells is cased with steel casing; at least one of the plurality of injection wells is cased with GFRE casing; and each of the plurality of injection wells is cased with GFRE casing.

This embodiment of the second step of the method of the present invention is preferred since interference with the artificial lift systems (pumpjack and electrical submersible pump) is avoided.

In this embodiment, regardless of whether the injection wells are cased with GFRE and/or steel casing, the injection wells are connected, either through the steel casing or through electrodes for GFRE cased wells, to a power source that allows the electrical signal to be applied.

In this embodiment, the wells cased with GFRE casing have the same advantages as described above.

The way in which the injection wells are connected will depend on the type of power source used, whether it is a single-phase power source or a three-phase power source. Some connection examples are: in case of having a single-phase power source and two injection wells, each terminal of the power source goes to one well, being one well positive (+) and the other negative (−); in case of having an even number of injection wells, one half is connected as positive and the other half as negative; in case of having a three-phase power source and three injection wells, one phase is connected to each well; in case of having a three-phase power source and more than three injection wells, each phase is connected to one or more injection wells; among other ways of connection. In all cases, the at least one production well remains in the center without being electrically connected.

The connection configuration in injection wells (anode and cathode) prevents the carbon steel production well (not connected) from deteriorating due to accelerated corrosion induced by anodic polarization.

It should be noted that in reservoirs under secondary recovery, the main driving force mobilizing crude oil is the dragging of water. The electrostatic forces generated by the DC signal to the crude oil are of a much lower order of magnitude than the water dragging forces, so if a DC signal is coupled to the AC signal (in charge of perturbing the oil-water interface and mobilizing the residual crude oil) the effect it will have on the direction of crude oil movement will be limited. Thus, knowing the flow pattern of the injected water for secondary recovery in the reservoir, injection wells can be selected to be connected as anode and cathode, to favor the movement of crude oil in the direction of at least one associated production well they surround.

As mentioned above, the electrical signal applied to the reservoir may be an alternating current signal or a combination of a direct current signal and an alternating current signal, where the frequency of the alternating current signal corresponds to the characteristic frequency of the oil-water interface of the system. This frequency is determined from electrochemical impedance tests with representative samples of water and crude oil from the reservoir to be treated. The characteristic frequency corresponds to an interval that is selected from the Nyquist and Bode plots (imaginary impedance vs. real impedance, and phase angle and magnitude vs. frequency) associated to the time constant generated by the water-crude oil interface. The applied current signal (AC, or AC and DC) disturbs the electrical charge balance that exists at the oil-water interface, destabilizing it and promoting the coalescence of the oil droplets. This phenomenon promotes the movement of the oil towards the production well(s), dragged by the sweep of the secondary or tertiary recovery.

Referring to FIG. 1A, a schematic drawing is shown showing an injection well 1 cased with GFRE casing and a production well 2 cased with GFRE casing, connected to a power source 3. Electrodes 4 are lowered down through said wells to the reservoir 5 allowing, once an AC signal or DC and AC combined signal is applied, the AC signal being at the characteristic frequency, the electrocoalescence of crude oil droplets and the displacement of the crude oil 6 towards the production well for its extraction. It should be noted that although one injection well and one production well are shown, as described above, there may be a plurality of injection wells and a plurality of production wells, each cased with GFRE casing, wherein respective electrodes are lowered, in each of said wells, to the reservoir of interest.

Said FIG. 1A shows how the impressed current electrical signal is applied between an injection well and a production well. In addition, it can be seen how the circuit closes through the reservoir following the path of least resistance. In the case of reservoirs under secondary recovery, this path is given by the strata with the highest water saturation. Regardless of the type of rock and its wetting, the electrical excitation of the crude oil will occur in all rock interstices where the crude oil is in direct contact with water.

Figure 1B:
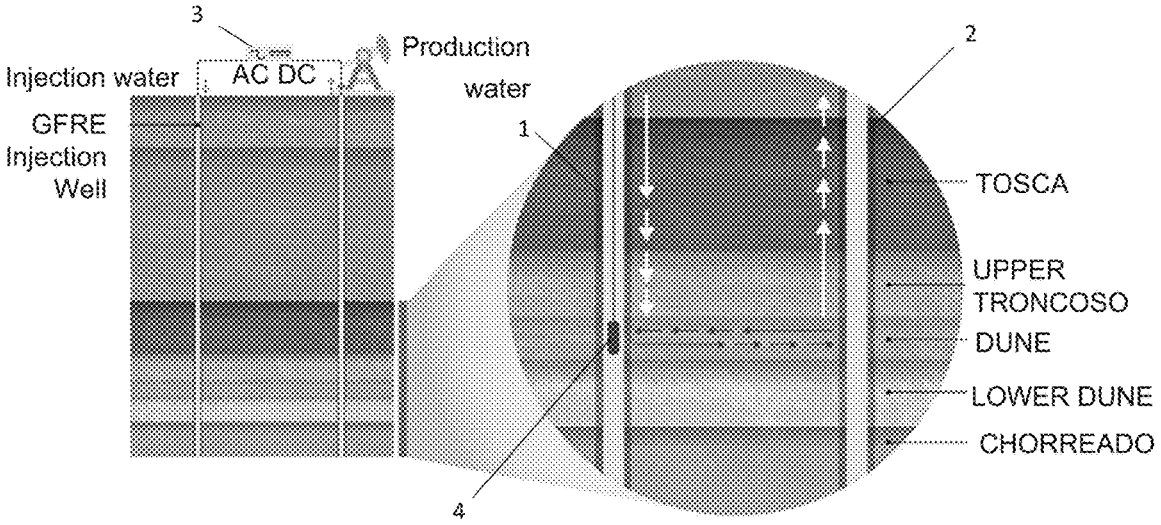
FIG. 1B shows a schematic drawing of another embodiment of the method of the present invention.

Referring to FIG. 1B, the connection between an injection well cased with GFRE casing and a production well cased with steel casing can be seen, whereby only the injection well has an electrode positioned in the zone of interest in the reservoir. It should be noted that although an injection well and a production well are shown, as described above, there may be, for example, a plurality of injection wells, some cased with GFRE casing (having their respective electrodes) and others with steel casing, and a plurality of production wells, each cased with steel casing; or there may be, for example, a plurality of injection wells electrically connected together, and surrounding one or more associated, but not electrically connected, production wells, where none, some, or all of said plurality of injection wells are cased with GFRE casing.

Figure 2:
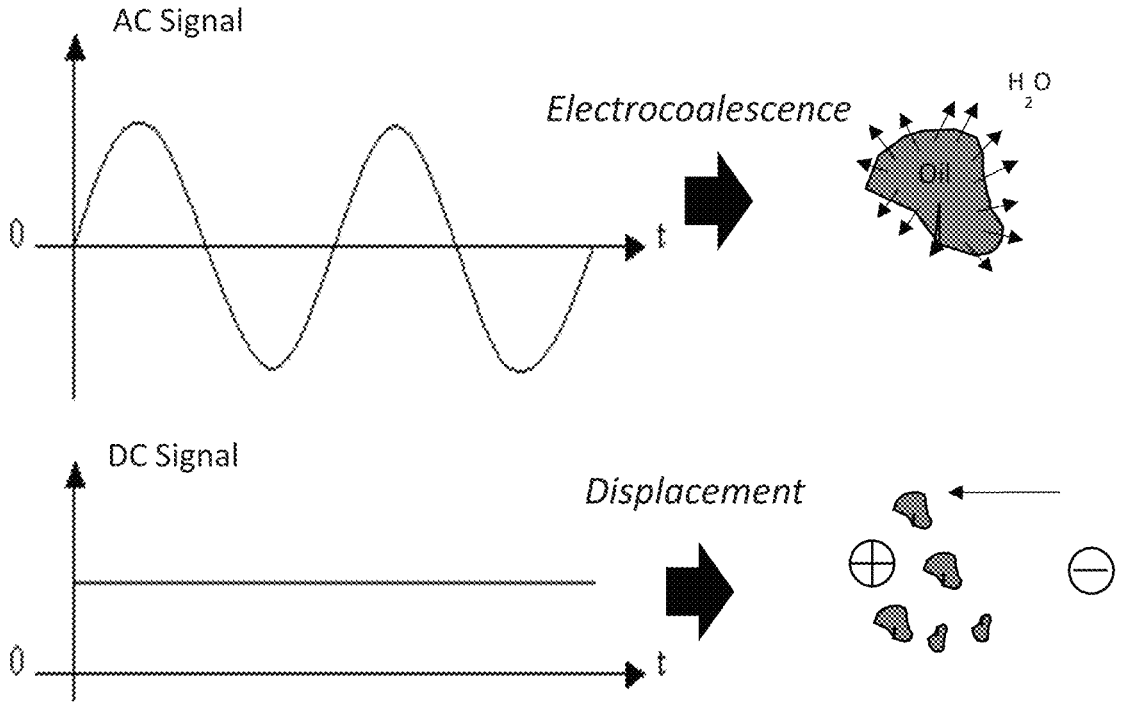
FIG. 2 shows the effects produced by a DC and AC combined signal in a reservoir.

Referring to FIG. 2, the effects produced by a DC and AC combined signal can be appreciated. In particular, it can be seen how the AC signal is responsible for producing the electrocoalescence of oil droplets retained in the pore network of the rock in order to increase the volume of oil extracted from a reservoir. Also, it can be seen how the DC signal generates a polarization (for example, between an injection well and a production well) promoting the displacement of crude oil from the cathode (negative) to the anode (positive). This allows the extraction of oil remaining in the reservoir through the production well and increases the efficiency of the secondary or tertiary recovery process.

Unlike the prior art patent documents, in particular, U.S. Pat. No. 4,228,854 A and WO 2016/045682 A1, which refer to the fact that the electrical signal can be AC, in both cases the focus is on DC signals. The method of the present invention focuses on first identifying the characteristic frequency of the oil-water system at which the highest disturbance of the oil-water system is generated, allowing to significantly increase the efficiency of the method of electrical stimulation.

Moreover, unlike methods known in the art in which electric current is applied to the oil formations to increase the temperature of the heavy crude oil (low API), through the Joule effect, to reduce its viscosity and promote its fluidity for extraction, the method of the present invention does not depend on the Joule effect and makes use of the characteristic frequency of the water-oil interface to generate the coalescence of the crude oil and favor its removal from the reservoir. The method of the present invention is applicable to both high API gravity (light) oil and low API gravity (heavy) oil.

It should be noted that the method of the present invention allows to increase in percentage the recovery factor of mature reservoirs generating a very significant impact on the recovery of oil in-situ or ROIP.

EXPERIMENTAL RESULTS

For the tests detailed below, crude oil samples from the mature reservoirs of Puesto Hernandez (PH) and Chihuido de la Sierra Negra (ChSN) were used. In particular, oil samples from these reservoirs were obtained from the wellhead to ensure the absence of additives (surfactants, biocides, inhibitors, etc.) that could modify the electrochemical behavior of the fluid samples. In this way, it was possible to obtain the characteristic frequency of the water-oil system corresponding to each reservoir and the improvement in EEOR efficiency was demonstrated by applying alternating signals at the characteristic frequency of these water-oil systems.

First, each of the fluids to be used is characterized separately by means of EIS spectra carried out in the laboratory to determine their electrochemical parameters, these fluids being injection water, production water and crude oil.

To this end, an electrochemical cell was used with two graphite electrodes, one at the inlet and the other at the outlet, 4 cm separated from each other, and two phases (water-oil), where said cell had tubular geometry. A potentiostat was used to establish a potential difference of 100 mV between the input and output electrodes.

Figure 3A:
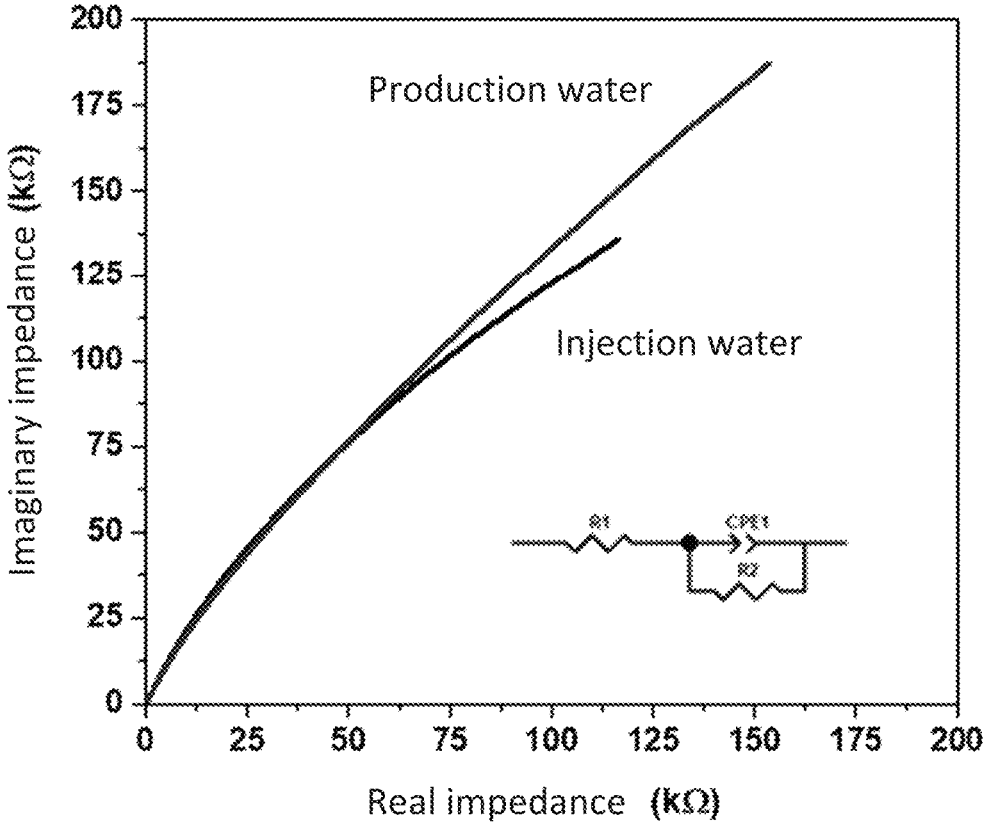
FIG. 3A shows the Nyquist plot obtained with injection and production waters, without crude oil, after an electrochemical impedance test.
Figure 3B:
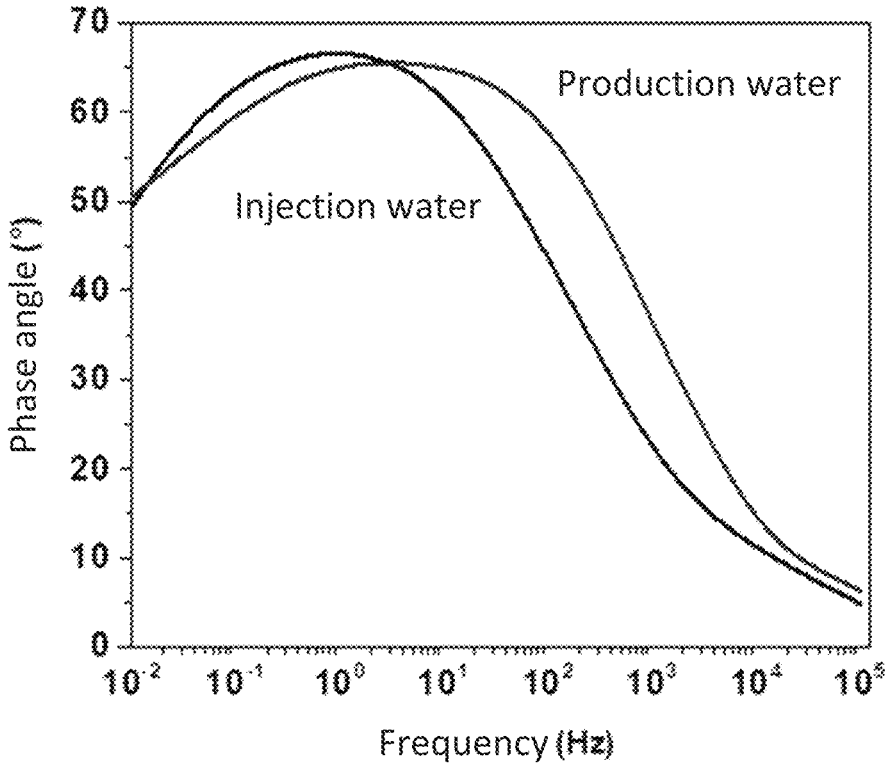
FIG. 3B shows the Bode plot obtained with injection and production waters, without crude oil, after an electrochemical impedance test.

FIGS. 3A and 3B show the Nyquist plot and Bode plot, respectively, obtained with the injection and production waters (without crude oil). Both spectra presented a similar response with a single time constant. In particular, FIG. 3A shows the equivalent electrical circuit of Randles to model the spectra obtained from the EIS spectra tested, where this circuit is formed by a resistance R1 in series with an impedance formed by a resistance R2 and a constant phase element (CPE) CPE1. It should be noted that the constant phase element is a component that models a non-ideal capacitor whose equation is as follows:

$$CPE = \frac{1}{(jw)^n C}$$

$$w = 2\pi f$$

where f is the frequency of the alternating signal at which the test is carried out, n is a coefficient between 0 and 1, where n equal to 1 represents an ideal capacitor and n equal to 0 represents a pure resistive element (without phase shift) and C is the capacitance value.

Table 1 shows the parameter values resulting from fitting the experimental results with Randles equivalent electrical circuit. The fitting was performed using Zview software. From these values the electrolyte conductivity (σ) was calculated, being 4.7 mS/cm for production water and 2.7 mS/cm for injection water. The difference between both values would be associated to the fact that the production water carries salts, solids, and crude oil from the formation.

TABLE 1

Electrochemical parameters calculated from the fit of experimental results using equivalent circuits.

| Water | R1 (Ω) | CPE | n | $R2_c$ (Ω) | C (mF/cm) | σ (mS/cm) |
|---|---|---|---|---|---|---|
| Production | 53.12 | 0.00003773 | 0.72401 | 701660 | 0.1315 | 4.7063 |
| Injection | 91.07 | 0.000024298 | 0.72332 | 726180 | 0.0728 | 2.7451 |

After having characterized both the production water and the injection water, the w/o interface, i.e., water-oil interface, was characterized. To this end, different water/oil ratios were analyzed in the electrochemical cell used. In particular, tests were carried out for the ratios 100:0 (oil:water), 75:25 and 50:50, where the 100:0 ratio allows, as it is obvious, the characterization of the oil separately. These ratios were performed for both production water with crude oil and injection water with crude oil.

Figure 4A:
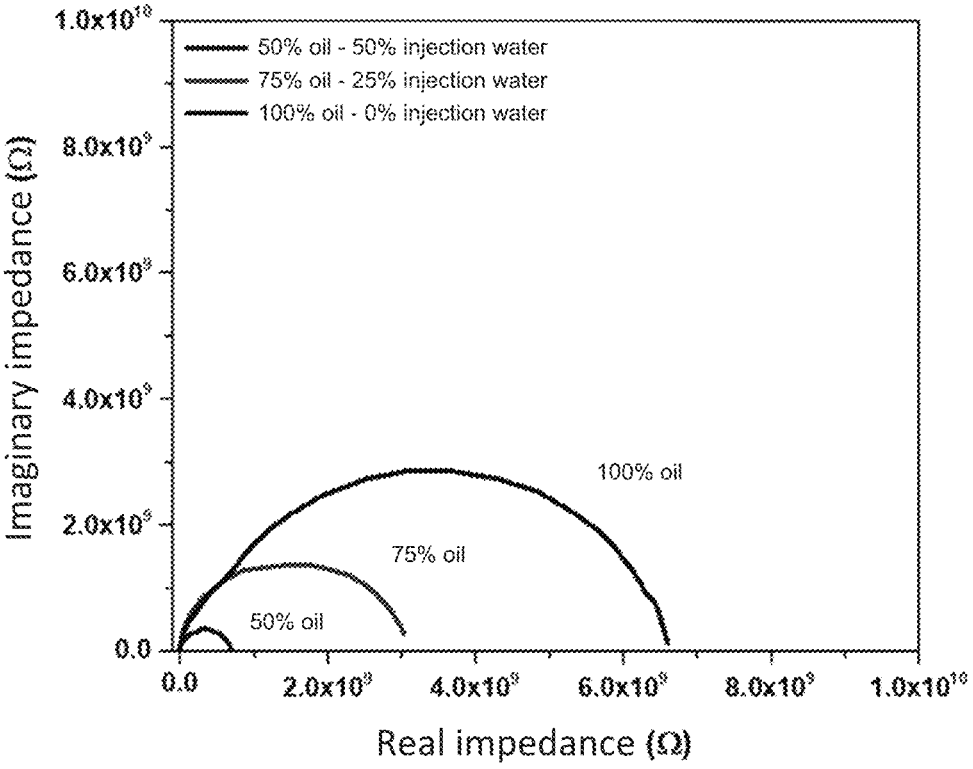
FIGS. 4A and 4B show the Nyquist plots obtained from the EIS spectra for different water cuts, where the Nyquist plot in FIG. 4A corresponds to water cuts using injection water and the Nyquist plot in FIG. 4B corresponds to water cuts using production water.
Figure 4B:
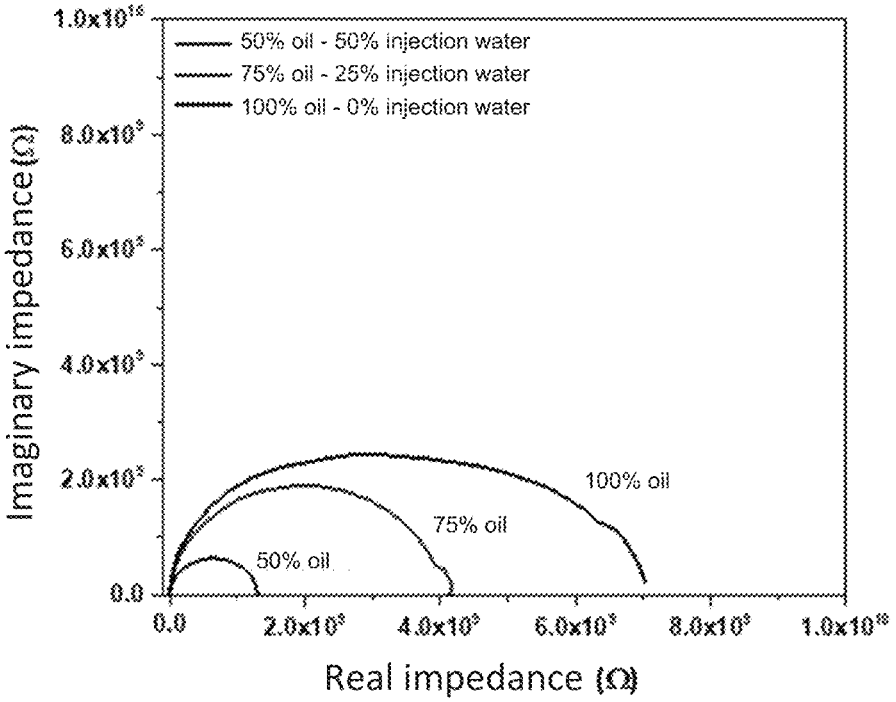

FIGS. 4A and 4B show the Nyquist plots obtained from the EIS spectra, where the Nyquist plot of FIG. 4A corresponds to water cuts using injection water and the Nyquist plot of FIG. 4B corresponds to water cuts using production water.

It can be seen from these plots that when the cell contains only crude oil (100:0) a semicircle is observed with a very large real impedance (approximately $7\times10^9\Omega$) and a single time constant. As the water cut increases, the magnitude of the resistive component of the impedance decreases.

The electrochemical parameters characterizing the w/o interface were obtained by fitting the spectra to a Randles equivalent electrical circuit identical to the one shown in FIG. 3A, but with different values for its components.

Figure 4C:
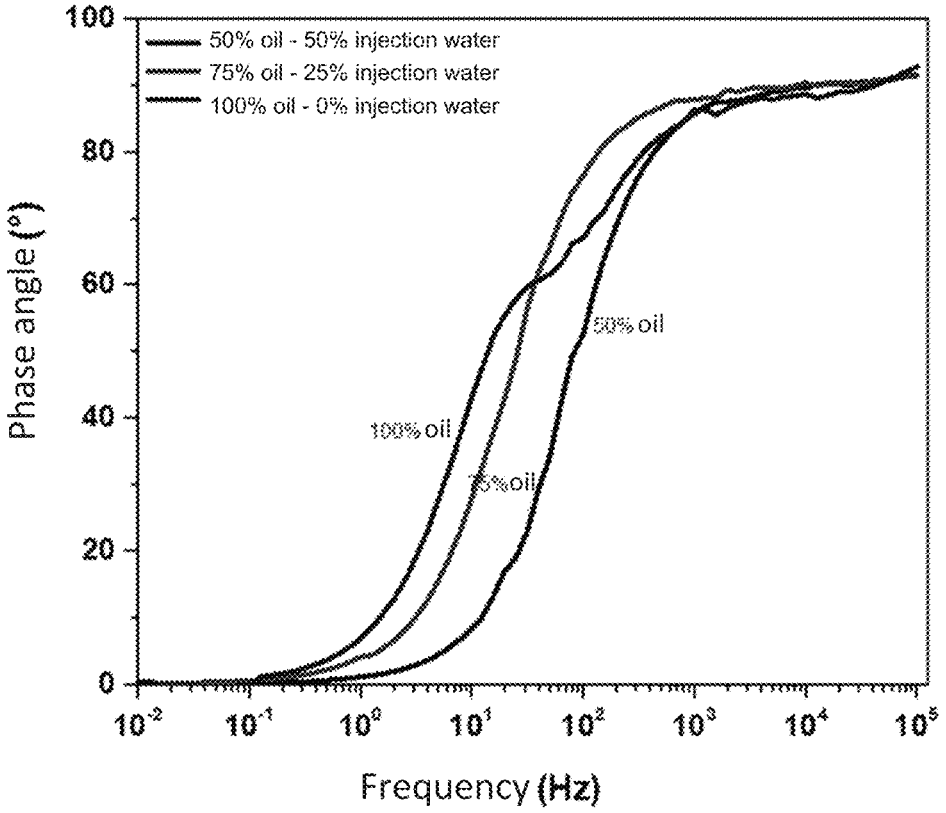
FIG. 4C shows the Bode plot for the different water cuts using injection water.

In such an equivalent circuit, the non-ideal capacitor (CPE1) is associated with the water-oil interface. The w/o emulsion microdroplets present at the interface accumulate electric charges modifying its dielectric constant. The electrical resistance of the crude oil (R2) is parallel to the non-ideal capacitor. As indicated above, R2 decreases as the water cut increases (the ratio of water to crude oil increases). FIG. 4C shows the Bode plot for different water cuts using injection water.

Below, Table 2 provides the characteristic electrochemical parameters of the different spectra obtained from the fitting of the equivalent electrical circuits.

TABLE 2

Electrochemical parameters resulting from the fitting of EIS spectra obtained with different w/o ratios.

| Sample | Oil:Water | CPE | n | R2 (Ω) | C (F) |
|---|---|---|---|---|---|
| Injection | 100:0 | 3.657E−12 | 0.942 | 6.24E+09 | 2.9034E−12 |
| | 75:25 | 1.537E−12 | 0.942 | 2.35E+09 | 1.0903E−12 |
| | 50:50 | 1.047E−12 | 0.942 | 7.05E+08 | 6.7417E−13 |
| Production | 100:0 | 4.048E−12 | 0.981 | 5.71E+09 | 3.7752E−12 |
| | 75:25 | 3.608E−12 | 0.991 | 3.88E+09 | 3.4796E−12 |
| | 50:50 | 2.010E−12 | 0.995 | 1.29E+09 | 1.9507E−12 |

As can be seen in Table 2, the resistance R2 presents values greater than 5 GC/when analyzing the 100% oil condition. This value decreases as the water cut increases. The two types of water tested show similar behavior with comparable values. On the other hand, the capacitance of the crude oil is of the order of $10^{-12}$ F. It should be noted that each of the CPE values shown in both Table 1 and Table 2 correspond to a certain spectrum.

Figure 5:
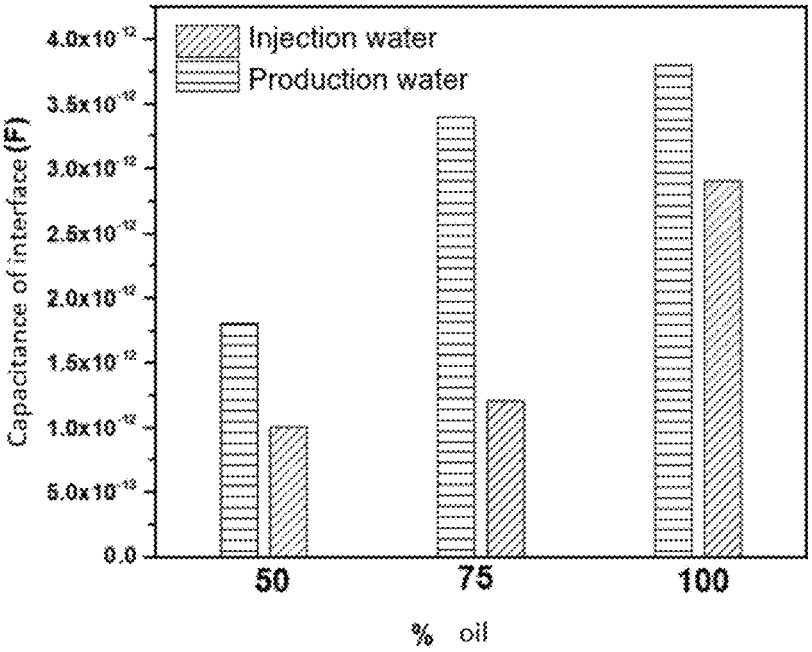
FIG. 5 shows the capacitance values measured for different water cuts after EIS.

FIG. 5 shows the capacitance values measured for the different water cuts. From these tests, the characteristic frequency of excitation corresponding to the type of water considered is given in Table 3:

TABLE 3

Characteristic frequency of excitation of crude oil in water.

| System | range | optimal |
|---|---|---|
| Crude oil PHz - Injection water | 1-250 Hz | 99.22 Hz |
| Crude oil PHz - Production water | 2-200 Hz | 47.71 Hz |

As can be seen, the characteristic frequency values obtained with the two types of water are not very different from each other.

Below, results obtained in other tests will be detailed to show how applying an alternating signal at the characteristic frequency of the w/o interface allows for greater efficiency in an EEOR recovery process. For these tests, an average value of the two optimal values of the characteristic frequency of the water-oil interface obtained in Table 3 is selected, this value being 73.5 Hz. It should be noted that, although in this case the average was selected, the frequency can be varied, depending on the response obtained, by some other value within the ranges of Table 3.

First Test

The first test carried out with this characteristic frequency is a sweep test in a synthetic porous medium. In more detail, tests were carried out by setting a characteristic frequency of 73.5 Hz for the AC signals, applying amplitudes of 0.5, 1 and 2 V; in addition to the application of DC signals at the same intensities, and AC and DC combined signals.

The tests in the synthetic porous medium were carried out with and without application of impressed current signal, while performing continuous sweeping with fluids through the synthetic porous medium which was created with packed sand. A crude oil trap was attached to the cell outlet to quantify the volume of oil recovered at each stage of the test.

Figure 6A:
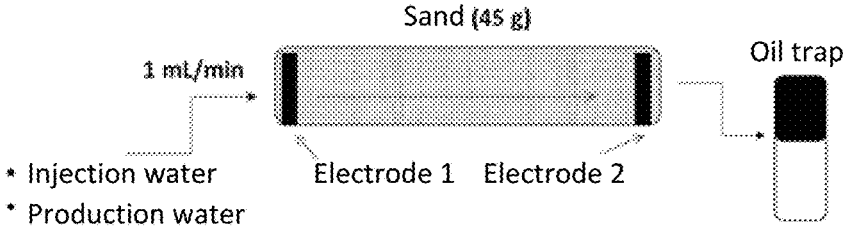
FIGS. 6A and 6B show, respectively, a schematic drawing of a cell and a test rig comprising said cell, used for a sweep test in a synthetic porous medium.

The test consisted of the following steps. First, the cell was assembled to perform the test. This cell is of tubular geometry with two electrodes, one at the inlet and one at the outlet of the cell, each electrode consisting of a stainless steel mesh. Between the two electrodes, 45 grams of sand were added. Each electrode had an external electrical connection. A schematic drawing of the cell used is shown in FIG. 6A.

The cell was then connected to a peristaltic pump and 250 ml of injection or production water was injected at a flow rate of 1 ml/min. The volume injected represents approximately 25 pore volumes (PV). This ensures that the sand is saturated in injection or production water. The pore volume should be understood as the fraction or percentage of the total volume of the rock, in this case the packed sand, that the pores of the rock form.

Then, the cell was swept with 100 ml of Puesto Hernandez crude oil which represents approximately 10 pore volumes.

Figure 6B:
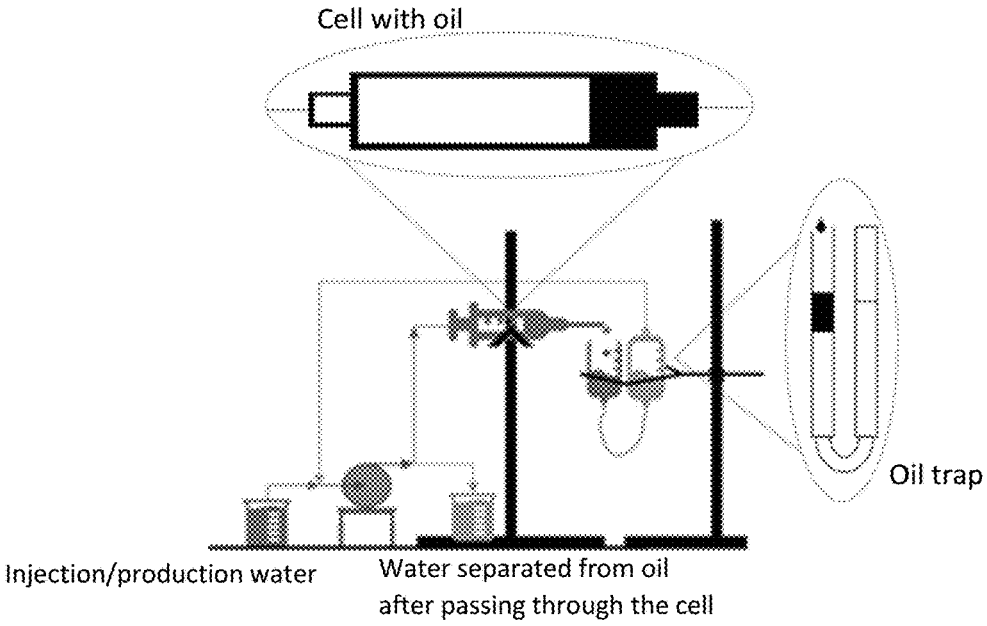

In a following step, injection or production water was again injected to displace the mobile crude oil. To this end, 250 ml of injection/production water (approximately 25 PV) was injected until SOR (residual oil saturation) was reached and the volume of oil displaced with water was measured using the trap (See FIG. 6B).

Finally, the impressed current was applied. To this end, the water sweep of 1 ml/min was maintained, and the impressed current signal was applied between the electrodes using a waveform generator set to the fixed frequency CF. The test ended once 200 ml of water (approximately 20 PV) was injected. The increase in crude oil recovery was measured.

Table 4 shows the results obtained in the sweep tests applying AC signals of different amplitude at 73.5 Hz. The SOR condition was reached after injecting 250 ml of injection water. During this stage of the test, an average of 34.14% of crude oil was recovered. After applying an alternating impressed current electrical signal with an amplitude of 2 V, an incremental oil recovery of 4% was obtained.

It can be seen that the efficiency of the method increases as the amplitude of the electrical signal increases. The OCP condition corresponds to the cell to which the electrical signal was not applied (blank). Table 5 shows the crude oil recovery values obtained in the different stages of the test when applying an alternating signal with a frequency of 15 Hz. In this case, after applying an alternating impressed current electrical signal with an amplitude of 2 V (without DC signal), an incremental crude oil recovery of 16.16% was obtained.

TABLE 4

Crude oil recovery values measured in the different stages of the test applying an AC signal at 73.5 Hz.

| Stage of the test | Retention and recovery | AC applied (73.5 Hz) 0.5 V | 1 V | 2 V |
|---|---|---|---|---|
| Oil saturation | Oil injected (mL) | 100 | 100 | 100 |
| | Oil recovered (mL) | 90 | 91 | 95 |
| | Oil retained (mL) | 10 | 9 | 5 |
| Recovery of mobile crude oil | Oil recovered (mL) | 3 | 2.2 | 2.4 |
| | Oil recovered (%) | 30 | 24.44 | 48 |
| Recovery of remaining crude oil by EEOR | Oil remaining (mL) | 7 | 6.8 | 2.6 |
| | Oil recovered (mL) | 0.05 | 0.1 | 0.2 |
| | Oil recovered (%) | 0.5 | 1.11 | 4 |

TABLE 5

Crude oil recovery values measured in the different stages of the test applying an AC signal at 15 Hz.

| Stage of the test | Retention and recovery | AC applied (15 Hz) OCP (Control) | 0.5 V | 1 V | 2 V |
|---|---|---|---|---|---|
| Water saturation | Water injected (mL) | 100 | 100 | 100 | 100 |
| | Water recovered (mL) | 91.5 | 91 | 92 | 92 |
| | Water retained (mL) | 8.5 | 9 | 8 | 8 |
| Oil saturation | Oil injected (mL) | 100 | 100 | 100 | 100 |
| | Oil recovered (mL) | 88 | 87 | 85 | 82 |
| | Oil retained (mL) | 13 | 14.21 | 12.2 | 13.1 |
| Recovery of free crude oil | Oil recovered (mL) | 4 | 3.5 | 3.9 | 3.2 |
| | Oil recovered (%) | 30.76 | 24.63 | 31.96 | 24.42 |
| Recovery of remaining crude oil by EEOR | Oil remaining (mL) | 9 | 10.71 | 8.3 | 9.9 |
| | Oil recovered (mL) | 0 | 0.4 | 1.1 | 1.6 |
| | Oil recovered (%) | 0 | 3.73 | 13.25 | 16.16 |

Comparing the results of Tables 4 and 5, it can be seen the effect of the frequency of the AC signal on the percentage of crude oil recovery, being the 15 Hz condition more effective than the one at 73.5 Hz.

Figure 7:
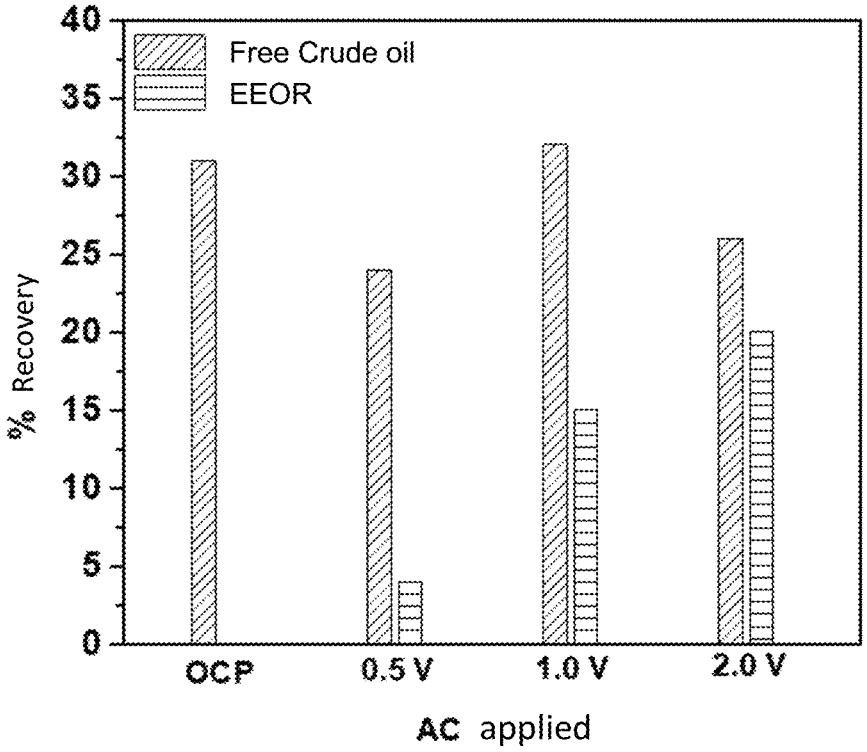
FIG. 7 shows the values of mobile crude oil and their corresponding increase in recovery due to the action of the impressed current signal, for the test of FIGS. 6A and 6B.

FIG. 7 shows the values of mobile crude oil and their corresponding increase in recovery due to the action of the impressed current signal at 15 Hz.

Second Test

The second test performed with the characteristic frequency obtained from the EIS tests is a sweep test in a natural porous medium. To this end, a cell was designed and built to perform sweep tests with core samples under reservoir conditions. A sample of crude oil from Chihuido de la Sierra Negra and synthetic injection water with a composition specific to this reservoir, were used.

Figure 8:
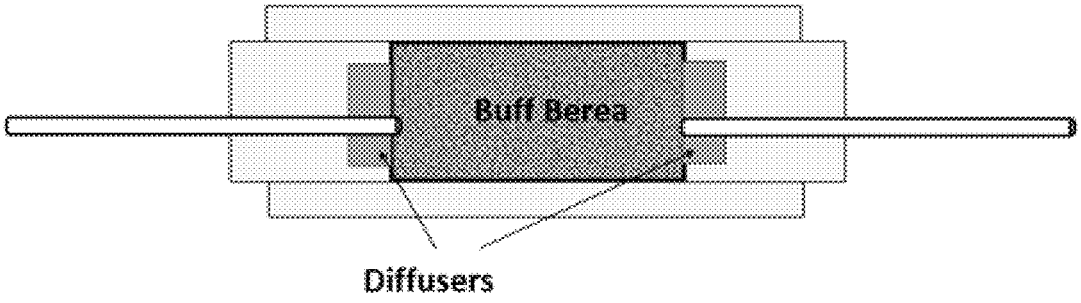
FIG. 8 shows the cell used for a sweep test in a natural porous medium.

The cell can accommodate core samples of 1.5" in diameter and is electrically insulated from its metallic body. Also, the cell comprises two electrodes that contact respectively the ends of the core sample and allow the passage of the injected fluids, and two diffusers as shown in FIG. 8.

The test was carried out at room temperature. A standard Buff Berea sandstone core sample with an initial weight of 89.286 g, a diameter of 37.37 mm, a length of 39.87 mm, a density of 2.657 g/ml, a pore volume of 11.44 ml and a porosity of 23.70%, was used.

The cell was electrically insulated from the pumping system. The core sample or plug and the diffusers were insulated with a latex film forming a diffuser-plug-diffuser assembly. This assembly was inserted into a rubber sleeve used to transmit the confining pressure. The confinement of the cell was performed with an Enerpac hand pump at a pressure of 1000 psi, using VINCI silicone oil.

During the test, the pressure differential was recorded using a Siemens sensor ranging from 0 to 100 bar (0 to 1400 psi).

The following is the detailed operating sequence of this test. First, prior to the sweep test, the core sample was saturated with ChSN synthetic water using a vacuum pump and mounted in the cell, where a confining pressure of 1000 psi was applied.

Then, 15 pore volumes (PV) were injected at a flow rate of 1 ml/min reaching a stable differential pressure and said differential pressure was recorded.

Then, 12 PV of crude oil were injected at a flow rate of 1 ml/min until reaching the condition of irreducible water saturation (SWI). During this sweep, 6 ml of water was recovered which represented a SWI=47%.

Next, 10 PV of synthetic water were injected until reaching the condition of residual oil saturation (SOR). At this stage, 3 ml of crude oil was recovered, reaching a SOR equal to 26%. Subsequently, 2 PV of water were injected at a flow rate of 2 ml/min.

The electrical signal was applied. For this, the sweep was maintained with ChSN synthetic water at 1 ml/min, a DC and AC combined impressed current signal was applied with an amplitude of 2.5 V DC and 2.5 V AC at a characteristic frequency of 2.5 Hz. Within a few seconds of applying the signal, it was observed that crude oil production was restarted. After injecting 12 PV of water, an incremental oil recovery of 0.8 ml was obtained, representing a SOR=19.6%.

Then, the sweep was suspended for 48 h. After this time, the test was resumed by injecting ChSN water again at 1 ml/min, without applying current. Approximately 0.3 ml of crude oil was recovered, achieving a SOR of 8.6%.

The current signal was then reapplied while maintaining the water flow rate, and approximately 0.5 ml of crude oil was recovered, achieving a SOR of 19.3%.

Figure 9:
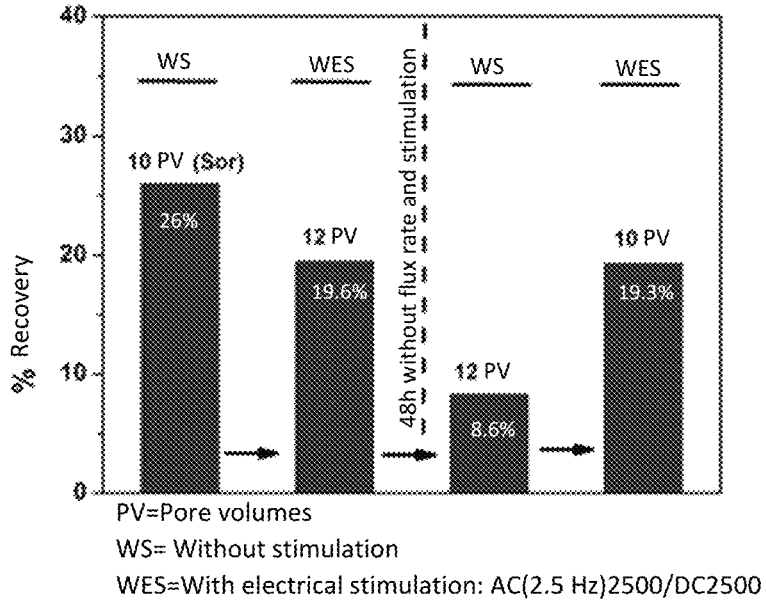
FIG. 9 shows the crude oil recovery results, related to the water sweep and the application of the electrical signal, obtained in the sweep test in a natural porous medium.

FIG. 9 shows the oil recovery results associated with the water sweep and the application of the electrical signal. The additional crude oil recoveries were 19.6% in the first stage of the test and 19.3% in the second stage.

Figure 10A:
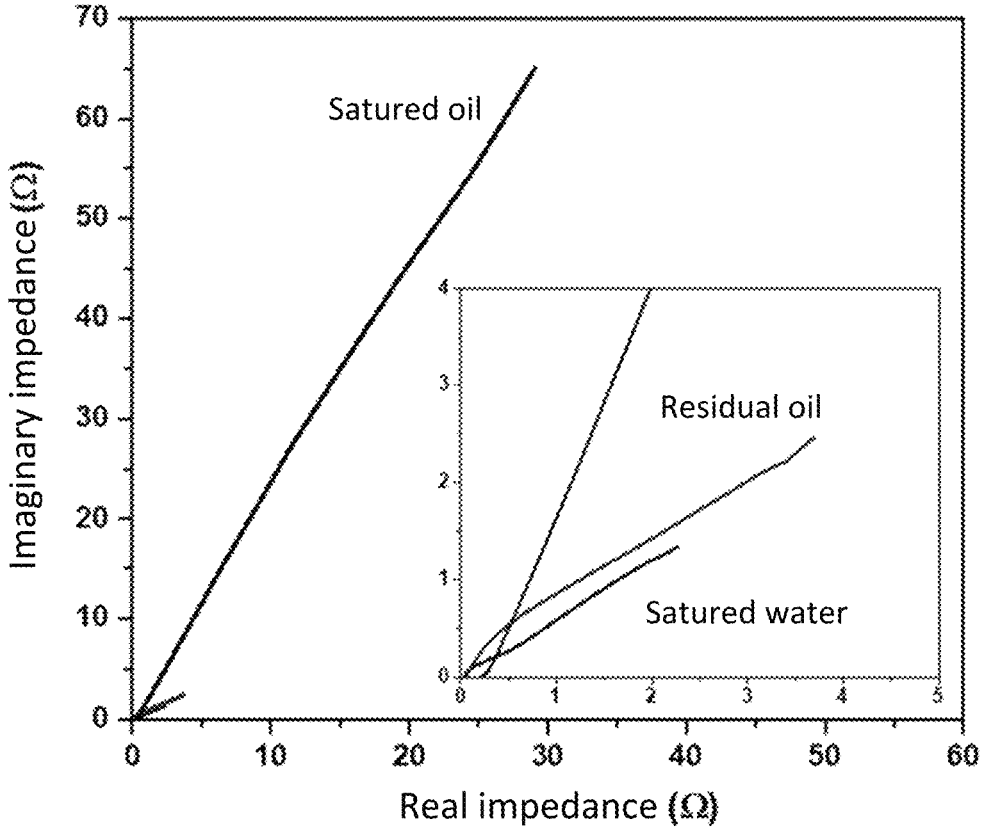
FIGS. 10A and 10B show the Nyquist plot and Bode plot, respectively, obtained in the different stages of the sweep test in a natural porous medium.
Figure 10B:
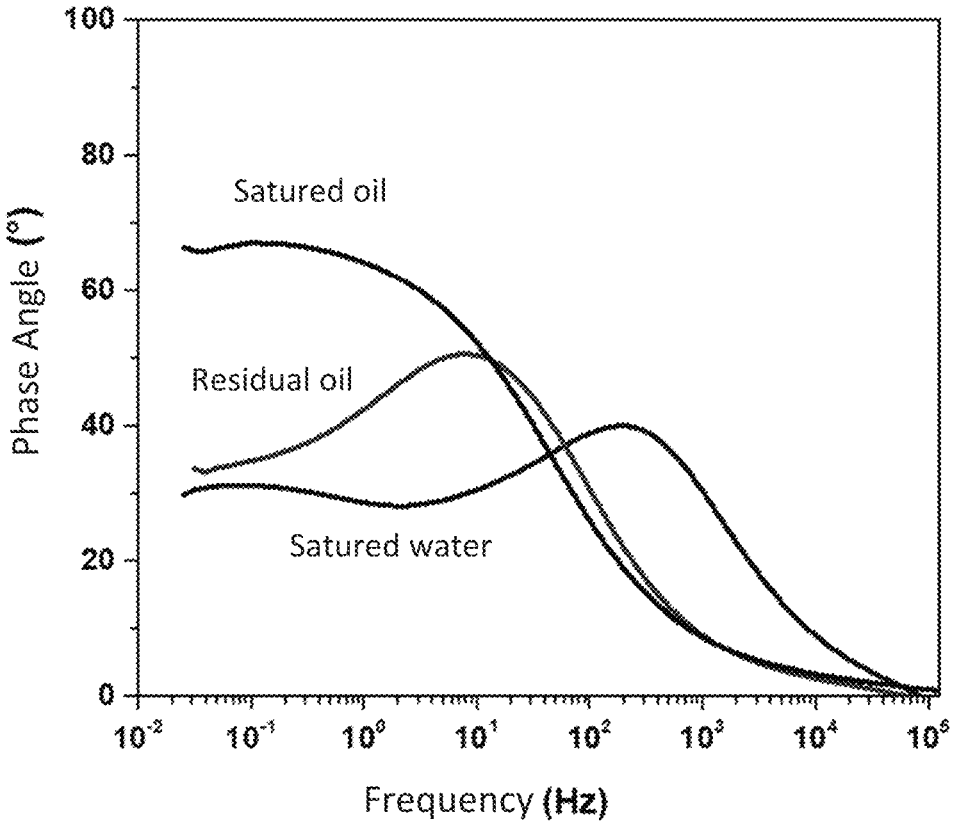

FIGS. 10A and 10B show the Nyquist and Bode plots, respectively, obtained in the different stages of the test. The incorporation of the synthetic rock (sand) in the system modifies the response of the impedance spectrum in a very appreciable way. It is no longer possible to visualize the time constant of the crude oil.

When the Berea core is 100% saturated in water, two time constants can be identified in the impedance spectra (Nyquist and Bode plots), one at high frequencies and the other at low frequencies. The response becomes even more complex when crude oil is added to the system, where a new time constant is identified at medium frequencies. Once the SOR condition is reached, a more stable response is obtained, similar to the spectra obtained in the 100% water saturated condition.

Third Test

The third test performed with the characteristic frequency obtained from the EIS tests is a test performed in a cell for microscope. This test was performed to demonstrate the effect of the impressed current signal on the behavior of the emulsions and the mobility of the crude oil under study. In particular, an electrochemical cell was used to characterize and observe the behavior of water/oil emulsions under an optical microscope while applying impressed current signals, both AC and DC.

The cell was fabricated from polyurethane and consists of a 10 ml chamber with glass at the upper and rear parts for the passage of light. In addition, the cell has a coupling for two graphite electrodes located respectively at the cell ends.

The tests were performed at room temperature by applying alternating and direct impressed current signals. A sample of PHz crude oil emulsified with production water from this reservoir was used.

For tests using alternating impressed current signals, AC signals with amplitudes ranging from 100 to 2000 mV were applied at a characteristic frequency of 70 Hz.

Figure 11:
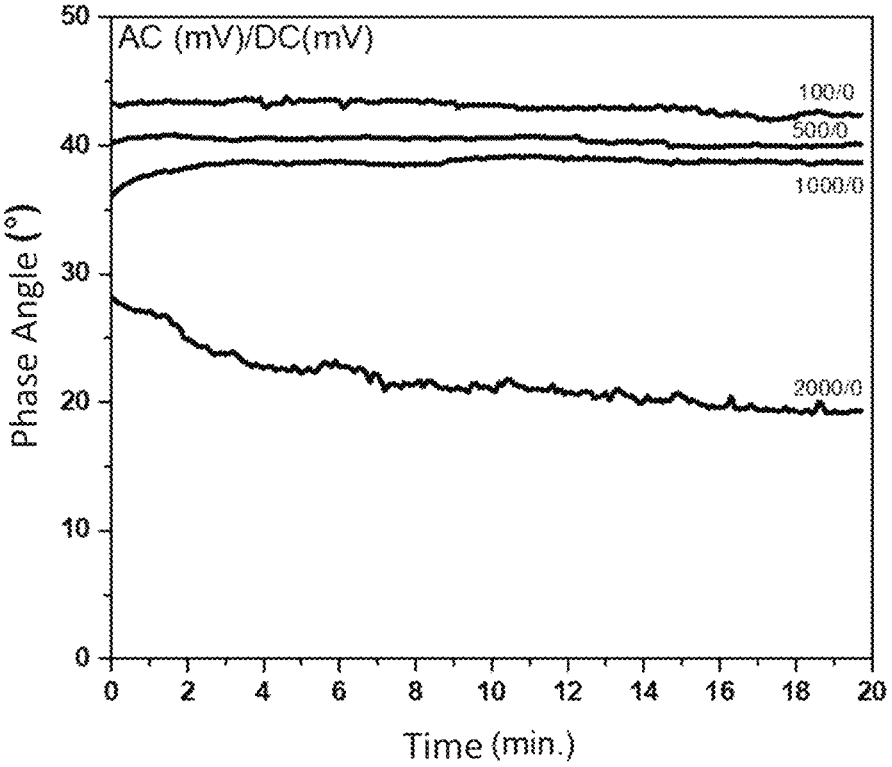
FIG. 11 shows the time variation of the phase angle of the impedance vector for AC signal amplitudes varying between 100 and 2000 mV in a test carried out in a cell for microscope.

FIG. 11 shows the variation in the phase angle of the impedance vector over time for AC signal amplitudes ranging from 100 to 2000 mV. It can be seen that the phase angle decreases as the AC signal amplitude increases. The responses remain practically invariant over time except for the 2000 mV condition, where the angle decreases with time. This variation is associated with capacitance and resistance changes in the oil and the water-oil interface due to electrocoalescence and dehydration phenomena.

Figure 12:
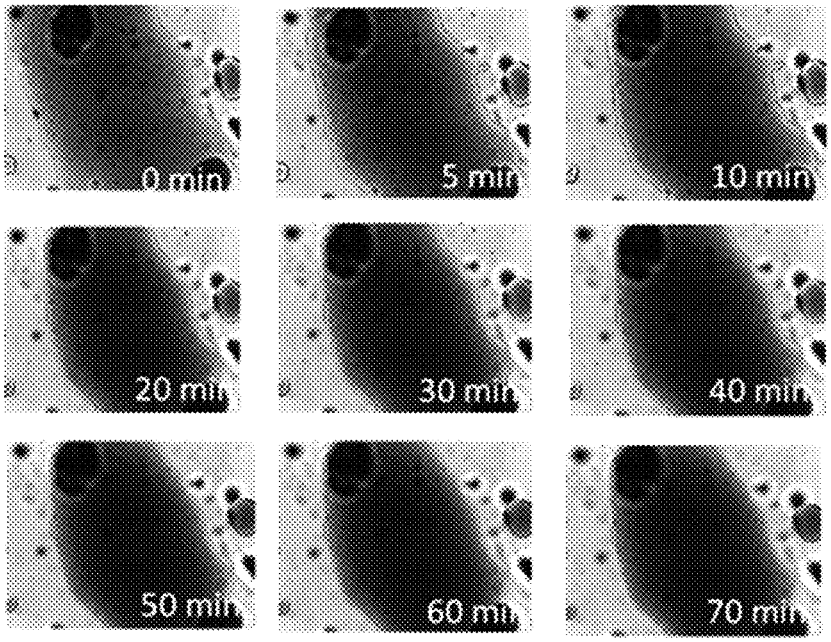
FIG. 12 shows a sequence of images taken under the microscope at 400×.

FIG. 12 shows a sequence of images taken under the microscope at 400×, showing the modification of a fraction of PHz oil surrounded by water, throughout the test, when an AC signal of 1000 mV is applied. The AC signal contributes to separate, i.e. break the emulsion, of water trapped in the oil. This effect becomes more pronounced as the amplitude of the applied signal increases.

Figure 13:
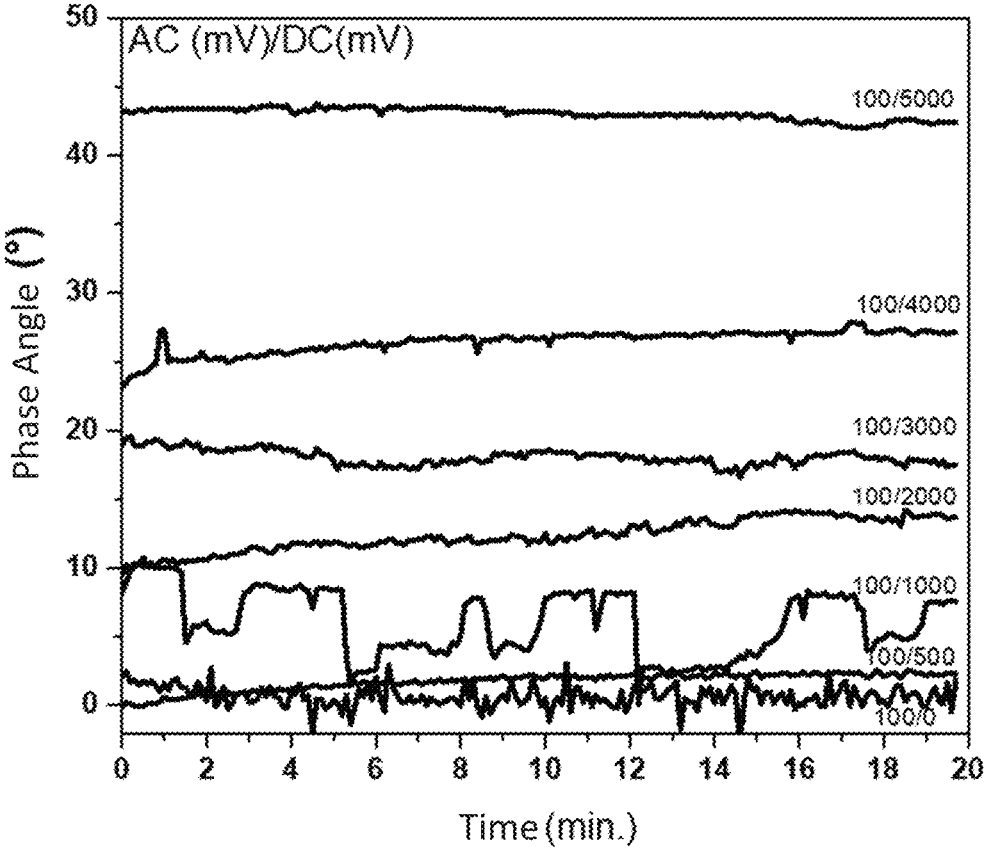
FIG. 13 shows the time variation of the phase angle at different DC signal amplitudes, coupling an AC signal of 100 mV at 70 Hz.

For the tests using DC and AC combined impressed current signals, the variation of the phase angle of the water/oil system with respect to time was evaluated at different direct current potentials, maintaining a fixed AC signal of 100 mV at a frequency of 70 Hz. In this case, the DC signal was varied between 0 and 5000 mV. FIG. 13 shows that the stability and magnitude of the phase angle decreases as the DC value increases. This behavior is more noticeable at DC potentials higher than 2000 mV.

Figure 14:
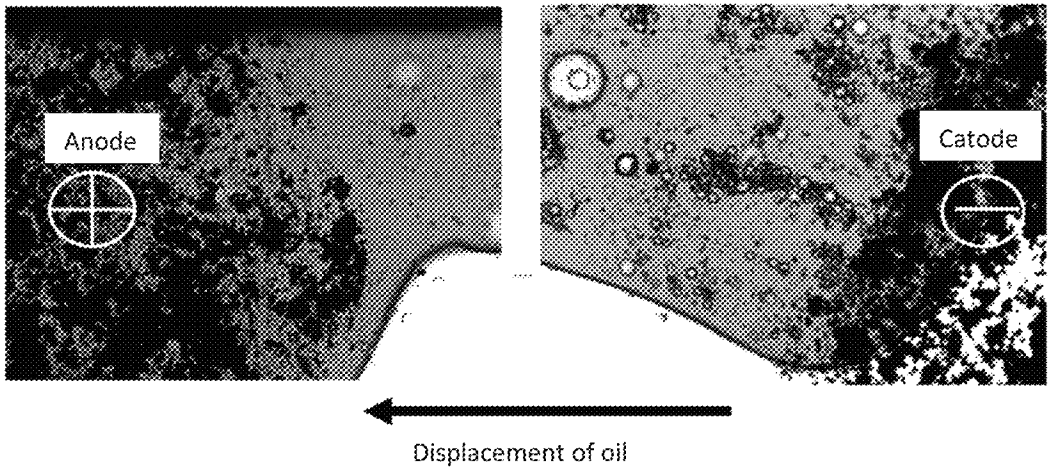
FIG. 14 shows how the electrodes (anode and cathode) look at the end of the test carried out in a cell for microscope

The application of the DC signal contributes to mobilize the polar fractions of the crude oil and ions in solution towards the electrodes. At the anode (+), the crude oil is concentrated and at the cathode (−) the water emulsions. FIG. 14 shows how the electrodes (anode and cathode) look at the end of the test. FIG. 14 shows the crude oil in black. This phenomenon increases with the increase of the DC signal.

The invention claimed is:

1. A method of oil recovery by applying an electrical signal to a reservoir of interest, wherein said method comprises the following steps:

obtaining the characteristic frequency of the water-oil interface of the reservoir; and applying the electrical signal to the reservoir, wherein said electrical signal is an alternating current signal or a combination of a direct current signal and an alternating current signal, wherein the frequency of the alternating current signal is the characteristic frequency of the water-oil interface, and wherein said electrical signal alters the water-oil interface to cause coalescence of oil droplets, thus generating coalesced oil droplets, and movement of the coalesced oil droplets for extraction.

2. The method according to claim 1, wherein the step of obtaining the characteristic frequency comprises collecting wellhead oil samples and water samples from the reservoir, and subjecting the oil samples and water samples to electrochemical impedance spectrometry tests.

3. The method according to claim 2, wherein the oil samples are combined with the water samples to obtain different water cuts or water-oil ratios from 100% water and 0% oil to 0% water and 100% oil, and subjected to electrochemical impedance spectrometry tests.

4. The method according to claim 3, wherein the electrochemical impedance tests are carried out by applying signals from 100 mHz to 1 MHz.

5. The method according to claim 4, wherein the impedance spectra obtained from the electrochemical impedance spectrometry tests are fitted to an equivalent electrical circuit to characterize the oil-water system and determine the characteristic frequency of the oil-water interface.

6. The method according to claim 5, wherein the equivalent electrical circuit is a Randles circuit.

7. The method according to claim 1, wherein the step of applying the electrical signal to the reservoir comprises connecting at least one injection well with at least one production well.

8. The method according to claim 7, wherein the at least one injection well and at least one production well are cased in one of the following ways:

the at least one injection well and the at least one production well are cased with steel casing; or at least one of the at least one injection well and the at least one production well is cased with glass fiber reinforced epoxy casing; or the at least one injection well and the at least one production well are cased with glass fiber reinforced epoxy casing.

9. The method according to claim 8, wherein the step of applying the electrical signal to the reservoir comprises applying the electrical signal directly through the steel casing for wells cased with steel casing, and through electrodes for wells cased with glass fiber reinforced epoxy casing, wherein said electrodes are lowered down, through the interior of each well cased with glass fiber reinforced epoxy casing, to the reservoir of interest.

10. The method according to claim 1, wherein the step of applying the electrical signal to the reservoir comprises connecting a plurality of injection wells together, wherein said injection wells surround at least one production well.

11. The method according to claim 10, wherein the plurality of injection wells that surround at least one production well is cased in one of the following ways:

the plurality of injection wells is cased with steel casing; or at least one of the plurality of injection wells is cased with glass fiber reinforced epoxy casing; or each of the plurality of injection wells is cased with glass fiber reinforced epoxy casing.

12. The method according to claim 11, wherein the step of applying the electrical signal to the reservoir comprises applying the electrical signal directly through the steel casing for wells cased with steel casing, and through electrodes for wells cased with glass fiber reinforced epoxy casing, wherein said electrodes are lowered down, through the interior of each well cased with glass fiber reinforced epoxy casing, to the reservoir of interest.

* * * * *